US005491186A

United States Patent [19]

Kean et al.

[11] Patent Number: 5,491,186

[45] Date of Patent: Feb. 13, 1996

[54] BONDED INSULATING BATT

[76] Inventors: James H. Kean, 2310 Linden Ave., Boulder, Colo. 80304; Tod M. Kean, 390 E. Ray Rd., Chandler, Ariz. 85224

[21] Appl. No.: 374,457

[22] Filed: Jan. 18, 1995

[51] Int. Cl.[6] ..... C08L 1/00; E04B 1/74; B32B 5/06; B32B 3/26

[52] U.S. Cl. ..... 524/13; 524/34; 524/35; 252/62; 428/298; 428/311.7

[58] Field of Search ..... 524/13, 34, 35; 252/62; 428/298, 373, 311.7; 162/141, 142, 147

[56] References Cited

U.S. PATENT DOCUMENTS

| | | | |
|---|---|---|---|
| 4,458,042 | 7/1984 | Espy | 524/14 |
| 4,468,336 | 8/1984 | Smith | 252/62 |
| 4,678,822 | 7/1987 | Lewellin | 524/12 |
| 4,804,695 | 2/1989 | Horton | 524/27 |
| 5,057,168 | 10/1991 | Muncrief | 156/62.6 |
| 5,071,511 | 12/1991 | Pittman | 162/145 |
| 5,134,179 | 7/1992 | Felegi, Jr. et al. | 524/13 |
| 5,225,242 | 7/1993 | Frankosky et al. | 427/209 |

*Primary Examiner*—Paul R. Michl
*Assistant Examiner*—LaVonda R. DeWitt
*Attorney, Agent, or Firm*—Donald W. Huntley

[57] ABSTRACT

Bonded insulation batt useful for thermal and acoustical insulation comprising secondary cellulose fiber, binder fiber and optionally lofting fiber, preferably bonded by a thermal process.

11 Claims, 1 Drawing Sheet

BONDED INSULATING BATT

BACKGROUND OF THE INVENTION

1. Field of the Invention

The present invention relates to bonded batt insulation useful for thermal or acoustic insulation. The insulating batt comprises secondary fiber and binder fiber bonded together. Bulking or lofting fiber can also be added to give additional volume to the insulating batt.

2. Description of Related Art

Loose fill secondary fiber insulation obtained from recycled paper has been in use for more than forty years. Such insulation is not bonded together and thus has no form or structure. A method to increase the bulk of secondary fiber loose fill insulation was disclosed in U.S. Pat. No. 4,468,336 wherein the addition of small amounts (2–8%) of synthetic fiber increased the bulk of the hammermill pulverized secondary fiber loose fill insulation. However, these advances did not lead to any form of bonded insulation.

Batt insulation can be made from a variety of materials such as fiber glass, rock wool, and textile materials. Processes for making a bonded insulating batt are described in Lewellin, U.S. Pat. No. 4,678,822 and Muncrief, U.S. Pat. No. 5,057,168. These processes use textile and binder fibers to form a batt using conventional textile carding and cross-lapping equipment. The resulting batt is then bonded.

A method for making a structured insulation material was developed by Horton and is disclosed in U.S. Pat. No. 4,804,695. Horton describes a method for producing spray cellulosic insulation and for wet spray open cavity insulation of such material. This method uses a composition which preferably comprises an adhesive and a wetting agent in water to moisten the material as it is blown into cavities. This process does not yield a product in batt form and it is necessary to transport the spray equipment to the job site. Furthermore, the density of these products is high.

None of the processes described above use secondary fiber as the insulating material, nor can secondary fibers be used in such processes.

With the continuing increase in energy costs, the need for a low cost, high performance insulation continues to grow. There is also a need to recycle secondary fiber such as newspapers so as to conserve natural resources. There is thus a need to provide a low cost, high performance insulation that can utilize secondary fiber. The product should also have a good recovery from compression, so that it regains most of its original bulk upon decompression.

SUMMARY OF THE INVENTION

The present invention provides a bonded insulating batt which utilizes secondary fiber, is light in weight and is convenient to install and easy to transport. In addition, the present invention provides an insulating material with low density and high resiliency.

Specifically, the present invention provides an insulating batt comprising a bonded fiber structure comprising secondary cellulose fiber having a density of up to about 1.5 lbs/cubic foot, about from 2.5 to 12% by weight of binder fiber, and up to about 25% by weight of lofting fiber, wherein the insulating batt has a density of up to about 2.5 lbs/cubic foot and the insulating batt recovers at least about 80% of its precompression volume upon decompression.

BRIEF DESCRIPTION OF THE DRAWING

The FIGURE is a graphical representation of the temperature during the preparation of products of the present invention.

DETAILED DESCRIPTION OF THE INVENTION

Figure 1:
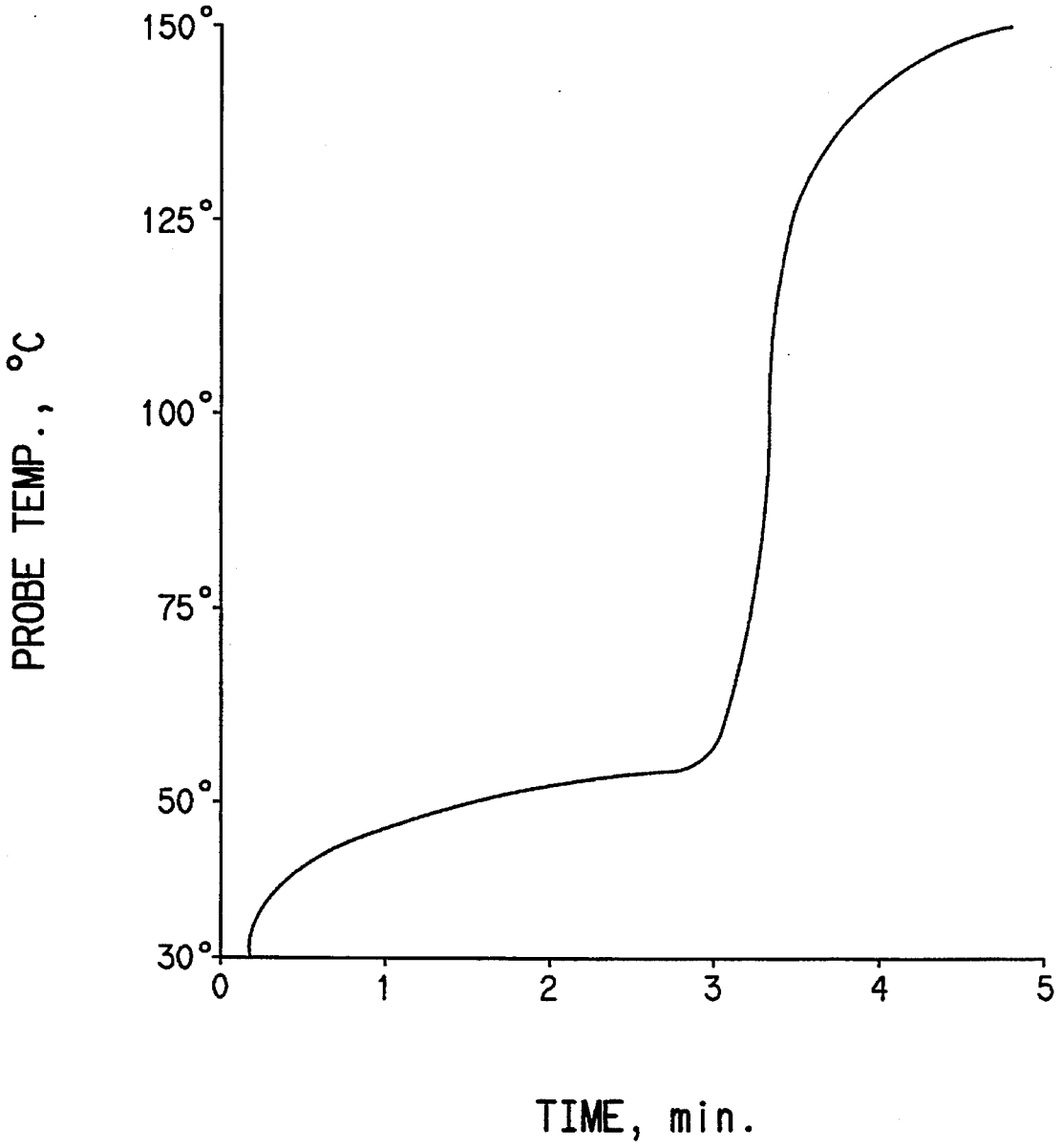

The insulating batt of the present invention is made up of secondary cellulose fiber, binder fiber and optionally lofting fiber.

The term "secondary cellulose fiber" as used herein refers to a defibered product obtained by a dry shredding process of newsprint or cardboard, or other similar ground wood products. The secondary cellulose fiber should have a density of up to about 1.5 lb/cubic foot. Densities, as noted herein, will be understood to refer to blown density as recognized in the art.

The desired density of the secondary cellulose fiber can be conveniently attained through the use of a processing apparatus that results in a relatively long comminuted fiber with low concentrations of dust. Thus, a disc refiner apparatus is more effective in preparing the secondary cellulose fiber than a hammer mill. The secondary fiber is typically treated with fire retardants before it is mixed with the binder fiber, and the fire retardant is included in the calculation of the density of the secondary cellulose fiber. To reduce the density of the secondary cellulose fiber, application of the fire retardant in liquid form, as opposed to the solids often used, is preferred. In general, about from 10 to 15 percent by weight of liquid fire retardant, based on the weight of the secondary cellulose fiber, has been found to be satisfactory for the present products.

Binder fiber as used herein includes a wide variety of thermoplastic fibers having melting point below the decomposition temperature of the secondary fiber. The binder is present in an amount of about from 2.5 to 12 percent by weight of the insultating batt. Preferably, less than about 10 weight percent, based on the total composition, of binder fiber is used, and about from 4 to 10 percent by weight has been found to be particularly satisfactory. In general, less than about 2.5 percent binder fiber does not provide a satisfactorily bonded product, while more than about 12 percent binder often increases the density of the final product more than desired.

A wide variety of binder fibers such as a sheath-core bicomponent fiber, polyethylene homo fiber, polyethylene pulp and the like can be used. Sheath-core bicomponent fibers are preferred, and especially those comprising at least one of:

(a) an activated copolyolefin sheath and a polyester core;

(b) a copolyester sheath and a polyester core; and (c) a crimped fiber with a copolyester sheath and a polyester core.

Of these fibers, those having an activated copolyolefin sheath and a polyester core are particularly preferred.

Bulking or lofting fiber as used herein can be a combination of one or more components selected from synthetic fibers such as polypropylene, polyester and the like and natural fibers such as jute and cotton. Chemically treated high bulk wood fibers, such as those commercially available from Weyerhauser, can also be used. Up to about 25 percent, by weight of the insulating batt, can be used, and the lofting fiber preferrably comprises at least about 1 percent by weight, and especially at least about 3 percent by weight.

The secondary cellulose fiber and the binder fiber, and any quantity of lofting or bulking fiber used, are admixed to give a homogenous mixture. The terms "lofting fiber" and "bulking fiber" are used interchangeably herein. The resulting admixture can then be formed into the desired batt configuration, and bonded. To minimize the density of the final product, the formed mixture is generally not compacted or compressed before bonding. Thermal bonding has been found to be particularly effective, and can be accomplished by treating a homogenous mixture of the components to elevated temperatures in a continuous through air oven. It is desirable to maintain the oven temperature somewhat higher than the fusion temperature of the binder fiber. This temperature will be the melting temperature of the binder fiber if a single component fiber is used, or the melting temperature of the sheath if a sheath-core binder fiber is used. Process conditions are controlled, along with the selection of the components and their concentration, such that the density of the resulting bonded insulation batt is up to about 2.5 lbs./cubic foot. Such a bonded product is generally satisfactory for acoustical insultation, while densities of up to about 2 lbs./cubic foot are generally preferred for thermal insulation. Flow of heated air through the batt should be carefully controlled, avoiding increase in air flow pressure on the batt surface and the batt itself. In this way the final density of the bonded product is minimized.

Preferably, lofting or bulking fiber is homogeneously mixed with the secondary fiber and binding fiber. Lofting fiber can be added along with the binder fiber. This homogenous mixture is then bonded together in a continuous air flow oven and the process conditions controlled such that the insulation batt has the density desired for the intended application, as described above.

Other bonding procedures can be used to produce the insulation batt of the present invention. A continuous oven in which heated air penetrates the batt by convection procedures can be used, but bonding time could be substantially longer than with a through air system. Another bonding method that can be used is radio frequency bonding as described in U.S. Pat. No. 5,139,861. Radiant heat can also be used. A combination of these techniques can also be used.

The selection and ratio of secondary fiber, binder fiber and lofting fiber used in making the instant insulation batt is such that it yields a high bulk insulation batt with densities up to about 2.5 lbs./cubic foot, and preferably less that about 2 lbs/cubic foot. The insulation batts of the present invention are light in weight, making them easy to install and convenient to transport. The insulation batts also have good compression recovery, that is, the batts recover a significant portion of their precompression volume upon compression and subsequent release of the compressive force. This is particularly important for thermal insulation, since thermal insulation is typically shipped over long distances which require compression to mininize shipping volume.

The invention is further illustrated by the following Examples and Comparative Examples. As used herein, all percentages are by weight unless otherwise indicated.

EXAMPLES 1–4 AND COMPARATIVE EXAMPLE A

In Examples 1–4 and Comparative Example A, 4% of various binders were admixed with 96% secondary fiber having a density of less than 2 lb./cubic foot in an industrial, 1 gallon Waring blender. The mixtures were drawn by vacuum into a mold, 10×10 cm by 6.5 cm deep. The mold, which had a screen as its base, replaced the conventional lid on the blender. With the blender motor on, suction was applied to the mold and the fibers were drawn up into the mold and randomly deposited on its screen.

The molded samples were then removed from the mold and placed in a convection air oven at 145°–155° C. Pads were bonded, for each binder type, for 10 and 20 minutes. The sample of Comparative Example A was not bonded in the oven. After cooling, all fused pads of Examples 1–4 could be dropped from a 1 meter height without rupturing. The extent of "dusting" that is, loss of secondary fiber upon tapping the pads on a hard surface, showed the following average ratings:

| Example | Binder Type | Designation | mp °C. | Dusting Rating |
|---|---|---|---|---|
| 1 | Bicomponent | Celbond T-105, PE sheath | 127 | 1.5 |
| A | Bicomponent | Celbond T-105, PE sheath | unbonded | 5.0 |
| 2 | Bicomponent | DuPont D-271, PET sheath | 110 | 3.5 |
| 3 | Fusible pulp | DuPont Pulplus, PE pulp | 127 | 0.0 |
| 4 | Homopolymer | Hercules PE fiber | 127 | 2.0 |

Dusting ratings: 0-Excellent, 1.0-Good, 2.0-Fair, 3.0-Poor, 4.0-Very Poor, 5.0-Complete Collapse of the Pad All binders after bonding produced a coherent web although there were differences in the amount of secondary fiber that flaked off with handling. In each example, the resulting bonded insulating batt had a density of less than about 2 lbs./cubic foot. If tested, the batts would each exhibit a compression recovery of at least about 80%.

EXAMPLES 5–12

Insulating batts were made in the general manner described in Examples 1–4 using textile fiber lofting component. In addition, the bonding procedure was modified to use a through air system. The unbonded batts were placed in a 10×10 cm form with impervious sides and a screen on the bottom. A small cooling fan of 65 cubic feet per minute capacity was mounted below the screen so that air was drawn through the unbonded batts by the fan. A digital thermometer sensing probe was placed on the screen with the wire oriented vertically into the pad. This unit was placed in an oven at 150° C. and the fan started. The flow of heated air was downward from the upper pad surface to the lower surface where the probe was located. A variety of factors, including pad thickness, density, and pad composition, affected the rate at which the heated air penetrated the pad. The FIGURE shows a typical time-temperature curve as measured by the temperature probe at the base of the pad. With 10 cm thick pads it takes several minutes for the temperature to rise above the fusion point of the binder fibers. There is an induction period in which the temperature rises slowly and then a rapid rise above the binder fiber fusion point is seen.

In these Examples the effect of the type of binder fiber and lofting fiber on bonded pad density and time for the temperature probe to reach fiber fusion temperature are illustrated. The binders were Hoechst Celanese Celbond T-105 bicomponent fiber with a polyethylene sheath and Hercules T-428 polyethylene homo-fiber. The lofting fibers were Weyerhaeuser HBA pulp and cleaned cotton waste from a textile mill.

EFFECT OF BINDERS AND LOFTING FIBERS ON PAD PROPERTIES
(5% Binder Fiber, 10% Lofting Fiber)

| Example | Code No. | Binder | Lofting Fiber | Density lbs./cu. ft. | Time, min. reach 130° C. |
|---|---|---|---|---|---|
| 5 | 5-11-3 | T-105 | HBA | 1.63 | 3:40 |
| 6 | 5-11-6 | T-428 | HBA | 1.69 | 4:25 |
| 7 | 5-19-3 | T-105 | HBA | 1.69 | 3:50 |
| 8 | 5-19-4 | T-428 | HBA | 1.63 | 4:45 |
| 9 | 5-19-5 | T-105 | Cleaned Cotton | 1.38 | 3:05 |
| 10 | 5-19-6 | T-428 | Cleaned Cotton | 1.50 | 3:25 |
| 11 | 5-19-1 | T-105 | None | 1.75 | 3:35 |
| 12 | 5-19-2 | T-428 | None | 1.75 | 4:55 |

The data shows that lofting fiber type affects density and that both lofting fibers give a lower density than the control. There appears to be little difference in densities with different binder fibers although with the cleaned cotton sample the Celbond T-105 is superior. The time to reach fusion temperature is loosely related to bonded pad density. If tested, the batts would each exhibit a compression recovery of at least about 80%.

EXAMPLE 13 AND COMPARATIVE EXAMPLE B

The general procedure of Example 1 was repeated, except that 5% of the binder fiber was used. The resulting batt was compressed to 6.25 cm and held at 16° C. for 5 days. After release it recovered to 8.3 cm in two days. This is a return to 83% of its original thickness. An unbonded pad of the same composition showed substantially no recovery under the same test conditions.

We claim:

1. A thermal insulating batt comprising a thermally bonded fiber structure consisting essentially of:

a) secondary cellulose fiber having a density of up to about 1.5 lbs/cubic foot;

b) about from 2.5 to 12 percent by weight of thermoplastic binder fiber having a melting point below the decomposition temperature of the secondary fiber; and c) up to about 25 percent by weight of lofting fiber different from the binder fiber;

wherein the insulating batt has a density of up to about 2.5 lbs/cubic foot and the insulating batt recovers at least about 80 percent of its precompression volume upon decompression.

2. An insulating batt of claim 1 wherein the binder fiber is at least one fiber selected from a group consisting of sheath-core bicomponent fiber, polyethylene homofiber, and polyethylene pulp.

3. An insulating batt of claim 2 wherein the sheath-core bicomponent fiber comprises at least one of:

(a) an activated copolyolefin sheath and a polyester core;

(b) a copolyester sheath and a polyester core; and (c) a crimped fiber with a copolyester sheath and a polyester core.

4. An insulating batt of claim 3 wherein the binder fibers have an activated copolyolefin sheath and a polyester core.

5. An insulating batt of claim 2 wherein the binder fiber has a melting point of up to about 135° C.

6. An insulating batt of claim 5 comprising up to about 10 percent by weight binder fiber.

7. An insulating batt of claim 6 comprising about from 4 to percent by weight binder fiber.

8. An insulating batt of claim 1 having a density of up to about 2 lbs/cubic foot.

9. An insulating batt of claim 1 comprising at least about 1 percent by weight lofting fiber.

10. An insulating batt of claim 9 comprising at least about 3 percent by weight lofting fiber.

11. An insulating batt of claim 9 wherein the lofting fiber comprises at least one of polypropylene, polyester, jute and cotton.

* * * * *

UNITED STATES PATENT AND TRADEMARK OFFICE

CERTIFICATE OF CORRECTION

PATENT NO. : 5,491,186

DATED : February 13, 1996

INVENTOR(S) : James Harvey Kean, Todd Mitchel Kean

It is certified that error appears in the above-indentified patent and that said Letters Patent is hereby corrected as shown below:

Claim 7, column 6, line 29, insert --10-- before "percent".

Signed and Sealed this

Thirteenth Day of May, 1997

*Attest:*

Bruce Lehman

BRUCE LEHMAN

*Attesting Officer*

*Commissioner of Patents and Trademarks*